US006102527A

United States Patent [19]

Tsukamoto et al.

[11] Patent Number: 6,102,527

[45] Date of Patent: Aug. 15, 2000

[54] IMAGE FORMING APPARATUS

[75] Inventors: Koji Tsukamoto; Kenji Tani, both of Yamatokoriyama; Shirou Wakahara, Kyoto, all of Japan

[73] Assignee: Sharp Kabushiki Kaisha, Osaka, Japan

[21] Appl. No.: 09/081,185

[22] Filed: May 19, 1998

[30] Foreign Application Priority Data

May 19, 1997 [JP] Japan ..... 9-128448

[51] Int. Cl.[7] ..... B41J 2/06

[52] U.S. Cl. ..... 347/55

[58] Field of Search ..... 347/55; 399/44, 399/353, 354

[56] References Cited

FOREIGN PATENT DOCUMENTS 6-218981 8/1994 Japan .

*Primary Examiner*—Matthew S. Smith
*Assistant Examiner*—Greg Moldafsky
*Attorney, Agent, or Firm*—Dike, Bronstein, Roberts & Cushman, LLP; David G. Conlin

[57] ABSTRACT

An object of the present invention is to provide an image forming apparatus for forming images which are always and stably high quality regardless of changes of ambient conditions. In the image forming apparatus, a counter electrode is disposed facing a toner holder for holding at least one color toner, to generate a potential difference between the toner holder and the counter electrode by use of various types of power supplies. Between the toner holder and the counter electrode, a counter electrode is interposed, which is provided with a plurality of gates disposed on an insulating substrate and electrode groups respectively disposed around the plurality of gates. According to the potential difference between the toner holder and the counter electrode, it is controlled whether or not the toner is caused to pass through the gates. In the image forming apparatus, a resistance value of a cleaning member is detected for removing the toner stuck on the control electrode. On the basis of the detected resistance value, ambient conditions are determined. On the basis of the conditions, a state of at least one of elements in the image forming apparatus is controlled.

9 Claims, 11 Drawing Sheets

IMAGE FORMING APPARATUS

BACKGROUND OF THE INVENTION

1. Field of the Invention

The present invention relates to an image forming apparatus which is applied to a printing unit of a digital copying machine and a facsimile machine, as well as to a digital printer, a plotter, or the like, and forms images onto a recording medium by jumping developer.

2. Description of the Related Art

There have been proposed printing methods for forming visible images onto recording media such as paper by using electric signals output from a computer, a word processor, a facsimile machine, etc.; the methods include, for example, an ink jet method using ink, a heat transfer method of transferring an image with fused ink, a method subliming chemicals coated on recording paper, an electrophotographic method, etc.

In recent years, in order to meet the demands of faster printing, higher printing quality and lower prices of printing, the ink jet method of non-impact image forming method that allows the apparatus to be formed integrally with a print head in a comparatively simplified configuration is increasingly adopted for image forming apparatuses. Since ink, which is a liquid, is used for the ink jet method, the ink is apt to ooze out on paper and a satisfactory image is difficult to obtain. Besides, in the case of color overprinting, mixed colors made by mixing inks cannot be obtained as expected. Therefore, the electrophotographic method with toner is adopted when high quality printing is required for formed images.

In printing with toner, the toner does not ooze out, and hence an image which has a thick color tone and is excellent in visual appeal can be obtained. In addition, in the case where a plurality of colors are mixed for the purpose of color printing, the colors are mixed in the fixing process and satisfactory mixed colors can be obtained. Accordingly, there is proposed a direct printing method with toner, which is a combination simple processes of the ink jet printing method and toner images.

A prior art technology for an image forming apparatus adopting the direct printing method with toner is disclosed in Japanese Unexamined Patent Publication JP-A 6-218981 (1994). A recording apparatus of JP-A 6-218981 is schematically configured in a manner that a toner holding roller attached to a toner case and a counter electrode are spaced, and between the toner holding roller and the counter electrode, an aperture electrode having a lot of openings is interposed. The electrical field around the respective openings of the aperture electrode is controlled so that a toner flow from the toner holding roller to the counter electrode is controlled. While the toner flow is controlled according to an image to print, recording paper is caused to pass through between the aperture electrode and the counter electrode. Thus, an image is formed onto the recording paper. The recording apparatus further comprises a brush roller for preventing the openings from being clogged with toner stuck on the aperture electrode. Each time an image is printed out, the brush roller comes in contact with the aperture electrode to remove the toner stuck on the aperture electrode.

In the above method that an image is directly formed onto recording paper by jumping such developing particles as toner, the amount of the jumping toner depends on changes of the ambient conditions. For example, when measured at a state where temperature is 20° C. and humidity is 40%, so-called state of normal temperature and normal humidity and at a state where temperature is 35° C. and humidity is 80%, so-called state of high temperature and high humidity, the toner jumping amount is less at the state of high temperature and high humidity.

As means for solving such problems, there has been a proposed method in which a temperature sensor, a humidity sensor, etc. are used to detect and correct ambient conditions and changes of those ambient conditions of the image forming apparatus. In this method, however, the image forming apparatus are provided with sensors and circuits for the sensors, resulting in an increase of the manufacturing cost of the apparatus. In the recording apparatus of JP-A 6-218981, a method for cleaning the aperture electrode in order to remove the toner stuck thereon, and nothing is taken into consideration for controlling the amount of jumping toner according to changes of the ambient conditions.

SUMMARY OF THE INVENTION

It is an object of the present invention to provide an image forming apparatus capable of controlling the amount of jumping toner in response to changes of the ambient conditions and forming a high quality image without using any part for detecting the changes of the ambient conditions.

In a first aspect of the invention, an image forming apparatus comprises:

supplying means having a holder for holding at least one color developer;

a counter electrode disposed facing the holder;

high voltage supplying means for supplying a high voltage to generate a potential difference between the holder and the counter electrode; and a control electrode having an insulating substrate disposed between the holder and the counter electrode, a plurality of gates which are provided on the insulating substrate and serve as passages of the developer, and at least one or more electrodes provided around the plurality of gates, the apparatus controlling by the potential difference generated between the holder and the counter electrode whether or not to pass the developer through the gates, to form images onto a recording medium conveyed between the control electrode and the counter electrode, the apparatus further comprising:

cleaning means for removing the developer deposited on the control electrode therefrom, the cleaning means being formed by a member having a characteristic value variable according to ambient conditions;

detecting means for detecting the characteristic value of the cleaning means;

determining means for determining the ambient conditions of the cleaning means based on a detection result of the detecting means; and state controlling means for controlling a state of at least one among the supplying means, the counter electrode, the high voltage supplying means and the controlling electrode, based on a determination result by the determining means, so that each of the supplying means, the counter electrode, the high voltage supplying means and the controlling electrode is brought in a state that desired images can be formed.

According to the first aspect of the invention, in order to control the state of the at least one among the supplying means, the counter electrode, the high voltage supplying means and the controlling means in response to the changes of the ambient conditions, the image forming apparatus has the cleaning means that is used for removing the toner stuck on the control electrode and is formed by a member with a characteristic value variable according to the ambient conditions, and detects the characteristic value to determine the changes of the environments. Accordingly, the image forming apparatus can determine changes of environments without a sensor, etc. used in a conventional image forming apparatuses, to always provide high quality images with a fixed amount of jumping toner. In other words, since the image forming apparatus can determine the ambient conditions without such means for detecting ambient conditions as a sensor, etc., the circuit configuration can be simplified. Further, regardless of the changes of the ambient conditions, the image forming apparatus can always provide stable images of high quality.

In a second aspect of the invention, the detecting means detects the characteristic value of the cleaning means at least before an image forming operation is started.

According to the second aspect of the invention, a variation of the amount of jumping toner, caused by the changes of the ambient conditions can be corrected when images are formed, so that stable images of high quality can always be formed regardless of the changes of the conditions.

In a third aspect of the invention, the state controlling means controls the potential of the control electrode.

According to the third aspect of the invention, the image forming apparatus can accurately correct the variation of the amount of jumping toner caused by the changes of the ambient conditions and always provide images of high printing quality regardless of the changes of the ambient conditions.

In a fourth aspect of the invention, the state controlling means controls the potential difference between the counter electrode and the holder.

According to the fourth aspect of the invention, the image forming apparatus can correct the variation of the amount of jumping toner caused by the changes of the ambient conditions with a simple circuit configuration, so that images of high printing quality can be provided and it can be realized to reduce the size and manufacturing cost of the apparatus.

In a fifth aspect of the invention, the state controlling means controls a potential applied to the supplying means.

According to the fifth aspect of the invention, the image forming apparatus can correct the changes of the toner characteristics caused by the changes of the ambient conditions, with a simple circuit configuration, to provide images of high printing quality without complicate correction control.

In a sixth aspect of the invention, the cleaning means is formed by a conductive fiber polymer.

According to the sixth aspect of the invention, in the image forming apparatus, the cleaning means is formed by the above-mentioned member in which the characteristic value is distinctly varied due to the changes of the ambient conditions. By accurately detecting the changes of the characteristic value by the use of the cleaning means, the image forming apparatus can precisely determine the changes of the ambient conditions to accurately control the respective elements used for forming images.

In a seventh aspect of the invention, the image forming apparatus further comprises storage means for previously storing a plurality of control data sets, which are used for changing the state of the at least one among the supplying means, the counter electrode, the high voltage supplying means and the controlling electrode, into a state that the developer can be conveyed by a predetermined amount under a plurality of predetermined ambient conditions, in correspondences to the plurality of conditions, wherein the state controlling means reads out any one of the control data sets corresponding to the condition determined by the determining means out of the storing means and controls the at least one among the supplying means, the counter electrode, the high voltage supplying means and the controlling electrode, on the basis of the control data set read out.

According to the seventh aspect of the invention, in the image forming apparatus, the plurality of control data sets are previously stored into the storing means, and corresponding to the determined ambient condition, any one of the plurality of control data sets is read out to be used for controlling the at least one among the supplying means, the counter electrode, the high voltage supplying means and the controlling means. Accordingly, regardless of the changes of the determined condition, the state of the at least one among the supplying means, the counter electrode, the high voltage supplying means and the controlling means, can be always controlled at ease so that the developer can be conveyed onto the recording medium from the supplying means by the specified amount.

In an eighth aspect of the invention, the detecting means includes a bridge circuit composed of the cleaning means and three resistors.

According to the eighth aspect of the invention, the detecting means of the image forming apparatus includes the bridge circuit. In this case, the characteristic value is a resistance value. When the resistance value of the cleaning means is changed, the volume of a current flowing in the bridge circuit is also changed. Consequently, the changes of the resistance value of the cleaning means can be detected by detecting the changes of the current flowing in the bridge circuit. Therefore, the changes of the ambient conditions can be detected easily. Thus, the detecting means can easily detect the changes of the ambient conditions using a very simple circuit.

In a ninth aspect of the invention, the determining means can determine humidity in the ambient air around the cleaning means as a present ambient condition, on the basis of the detection result by the detecting means.

According to the ninth aspect of the invention, the detecting means of the image forming apparatus detects the changes of the humidity in the air. This is because the amount of the developer jumping from the supplying means toward the counter electrode is changed according to the humidity. Consequently, the image forming apparatus controls the state of the at least one among the supplying means, the counter electrode, the high voltage supplying means and the controlling means, on the basis of the humidity, to always maintain an amount of the jumping developer at the specified amount, regardless of the humidity, with the result that the apparatus can stably form images of high quality.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
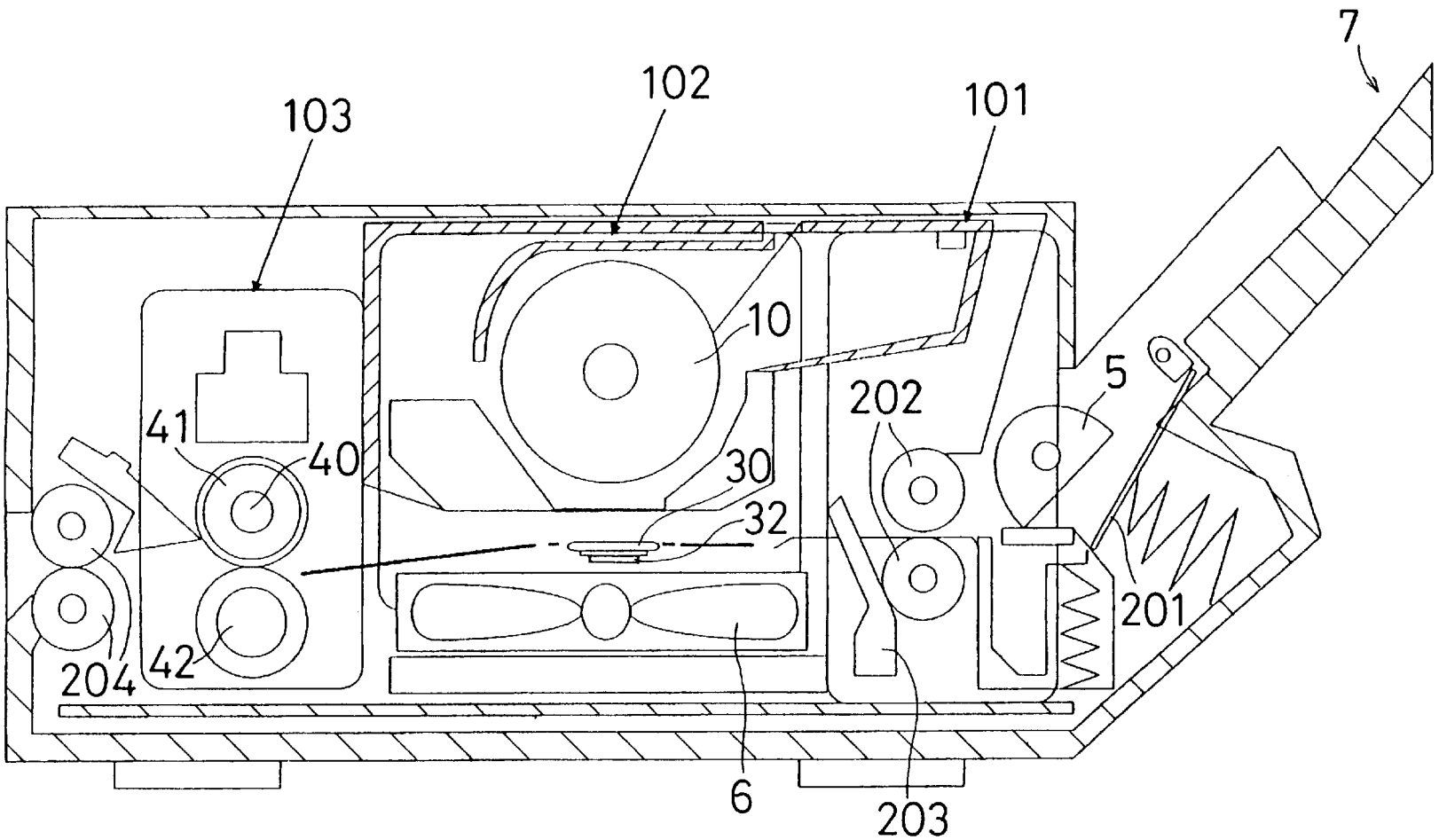
FIG. 1 is a cross sectional view explaining a mechanical configuration of a printer provided with an image forming apparatus of a first embodiment of the present invention as an image forming unit for printing.

Now referring to the drawings, preferred embodiments of the invention are described below.

Figure 2:
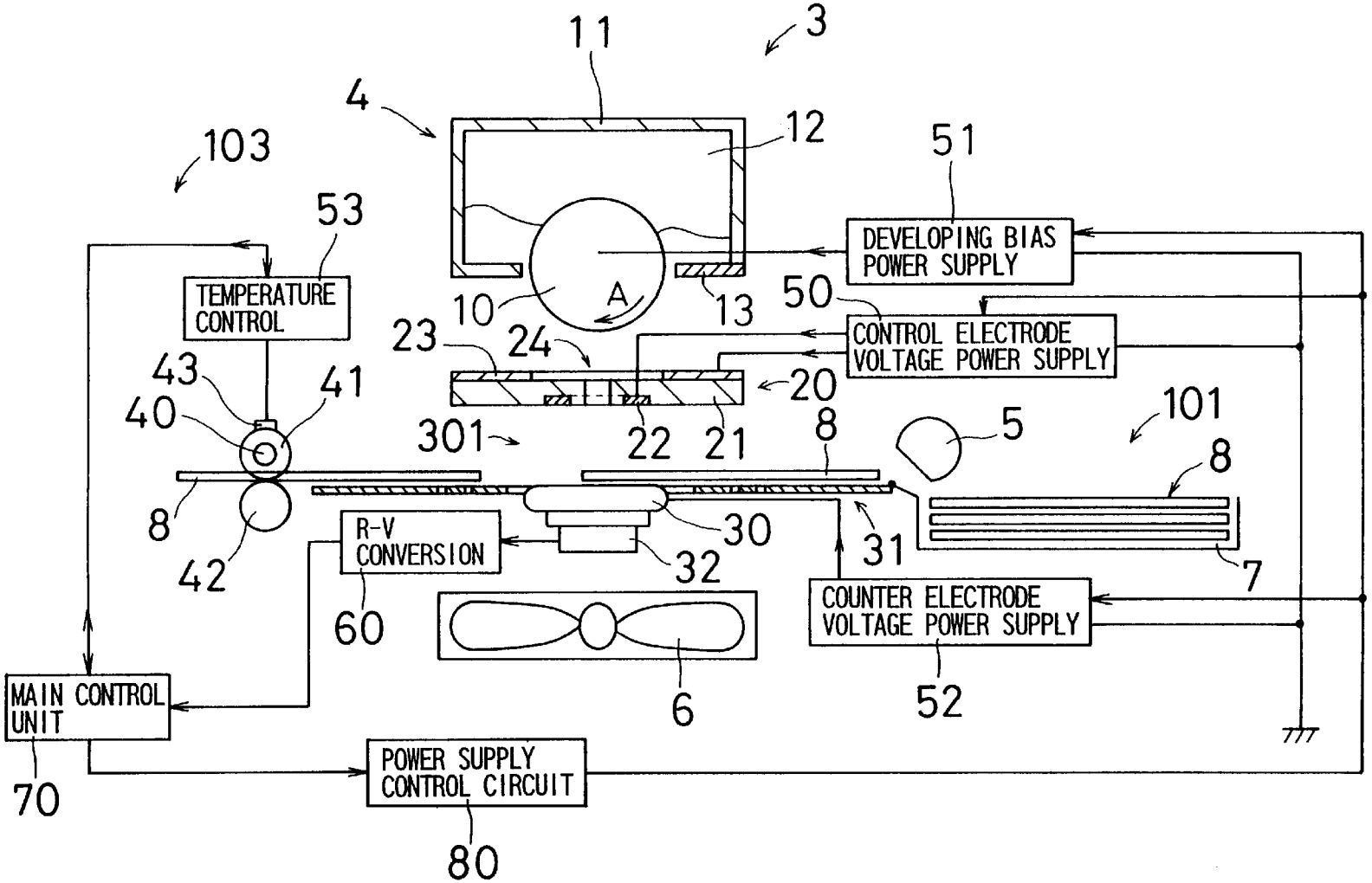
FIG. 2 is a view showing a concept of a major portion of the printer.
Figure 3:
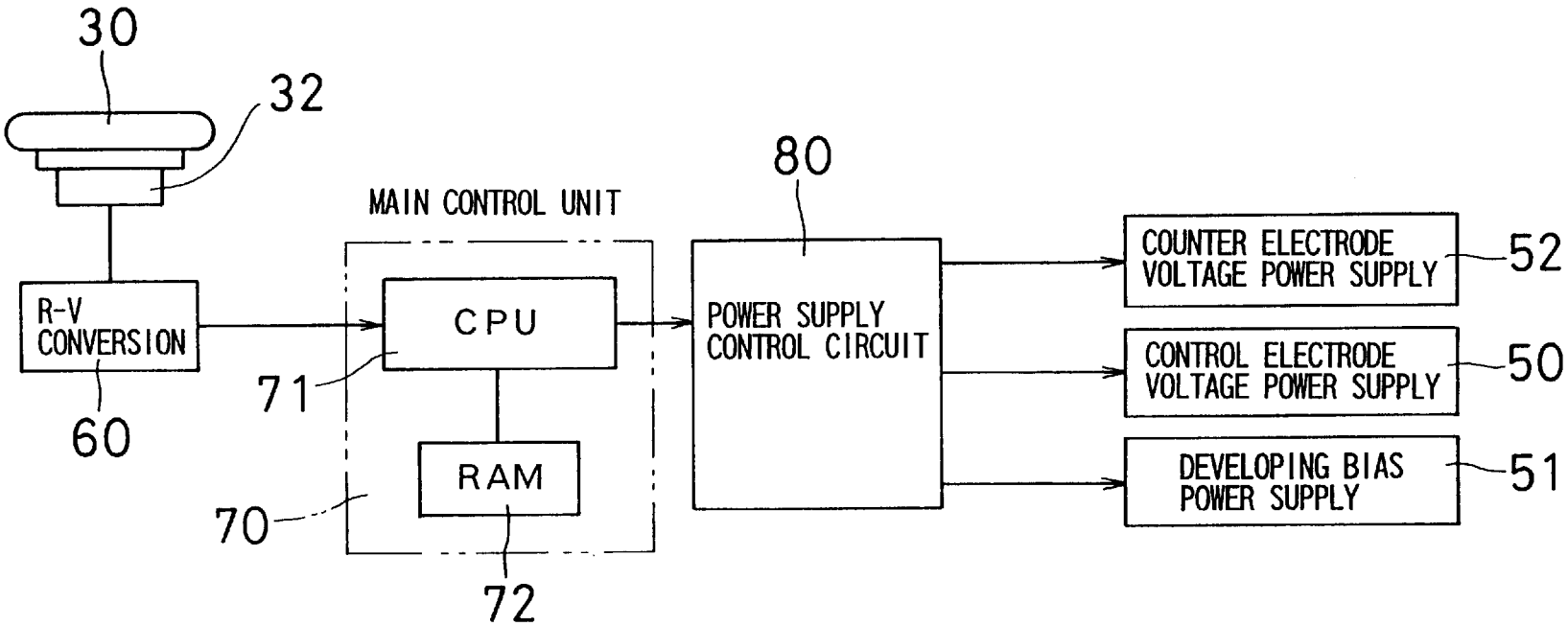
FIG. 3 is a view showing an electrical configuration of a main control unit 70 in the printer of the first embodiment.

FIG. 1 is a view showing a mechanical configuration of a printer provided with the image forming apparatus of the present invention as an image forming unit for printing an image. FIG. 2 is a block diagram showing a schematic configuration of the printer. FIG. 3 is a block diagram showing a portion related to voltage controlling of various types of electrodes disposed to the printer. Hereunder, the preferred embodiments of the present invention will be described referring to FIGS. 1 to 3.

The printer comprises an image forming unit 3, a paper feeder 101, a fixing unit 103, a paper ejection roller 204, and an ejected-paper tray. The image forming unit 3 comprises a toner supplier 4, various types of power supplies 50 to 52, a printing device 301, an R-V converter circuit 60, a main control unit 70, and a power supply control circuit 80.

Hereunder, the image forming apparatus with a configuration corresponding to negatively charged toner containing magnetic substances will be described in detail. When positively charged toner is used, the polarity of each voltage to be applied may be set in accordance with the toner as needed.

A printing unit 102, that is, the image forming unit 3 develops an image according to an image signal from a host computer (not illustrated) onto paper 8 serving as a recording medium by use of toner 12 serving as a developer. In other words, the image forming apparatus of the invention controls jumping of the toner 12 based on an image signal to form an image onto paper.

At the inlet side of the paper to be fed into the image forming unit 3, the paper feeder 101 is disposed. The paper feeder 101 includes a paper cassette 7 for holding the paper 8 serving as a recording medium, a pick-up roller 5 for feeding the paper from the paper cassette 7, a paper guide 201 for guiding the fed paper 8, and a pair of registration rollers 202. The paper feeder 101 further includes apaper feed sensor 203 for detecting that the paper 8 is fed into the image forming unit 3. The pick-up roller 5 is driven by a driving unit (not illustrated).

At the outlet side of the paper 8 from the image forming unit 3, the fixing unit 103 for heating and pressing a toner image formed onto the paper 8 in the image forming unit 3 to fix onto the paper 8. The fixing unit 103 includes a heater 40, a heating roller 41, a pressure roller 42, a temperature sensor 43, and a temperature control circuit 53. As the heating roller 41 is selected, for example, an aluminum tube having a thickness of 2 mm. The heater 40 is formed, for example, by a halogen lamp and incorporated in the heating roller 41. The press roller 42 is made of a material such as silicon resin.

The heating roller 41 and the press roller 42 that are disposed facing each other are under a load (e.g., 2 kg) by springs etc. (not illustrated) provided at both ends of the shaft of the respective rollers, so as to interpose and press the paper 8 by the rollers. The temperature sensor 43 measures a temperature of the surface of the heating roller 41. The temperature control circuit 53, which is controlled by the main control unit 70 to be described later, controls an operation that the heater 40 is turned on/off, etc. based on the measurement result of the temperature sensor 43, so that the temperature of the surface of the heating roller 41 is maintained at a certain temperature (e. g., 150° C.). The fixing unit 103 has an ejected-paper sensor (not illustrated) for detecting that the paper 8 is ejected.

The materials of the heater 40, the heating roller 41, the press roller 42, etc. are not specified specially. Further, the temperature of the surface of the heating roller 41 is not specified specially. Furthermore, the fixing unit 103 may be configured in a manner that the paper 8 is heated or pressed to fix a toner image thereon.

At the outlet side of the paper 8 from the fixing unit 103, the paper ejection roller 204 for ejecting the paper processed in the fixing unit 103 onto the ejected-paper tray and an ejected-paper tray for receiving the ejected paper 8 are provided. The heating roller 41, the press roller 42, and the paper ejection roller are driven by a driving unit (not illustrated).

The toner supplier 4 of the image forming unit 3 includes: a toner tank 11 for holding the toner 12 serving as a developer; a toner holder 10 serving as a cylindrical holder (sleeve) for holding the toner 12 by an electric force; a driving unit (not illustrated) for rotating the toner holder 10; a doctor blade 13 which is provided in the toner tank 11 and used for charging the toner 12 as well as regulating the thickness of a toner layer held on the outer peripheral surface of the toner holder 10; and a developing bias power supply 51 for applying a voltage to the toner holder 10.

The doctor blade 13 is provided at the upstream side of in the rotating direction of the toner holder 10 so as to be, at a distance (e.g., 60 $\mu$m) from the outer peripheral surface of the toner holder 10. The toner 12 is magnetic toner whose particles have, for example, an average diameter of 6 $\mu$m and is charged by the doctor blade 13. The distance between the doctor blade 13 and the toner holder 10 is not specified specially. Further, the average diameter of the particles of the toner 12 is not specified specially. The toner holder 10 is driven by a driving unit (not illustrated) and rotated in a direction of arrow A in the figure. In addition, the toner 12 held on the outer peripheral surface of the toner holder 10 there forms bristles.

The printing device 301 of the image forming unit 3 includes: a counter electrode 30 facing the outer peripheral surface of the toner holder 10; a cleaning member 32 attached to the counter electrode 30; a driving unit (not illustrated) for rotating the counter electrode 30; a counter electrode voltage power supply 52 for supplying a high voltage to the counter electrode 30; a control electrode 20 provided between the toner holder 10 and the counter electrode 30; and a fan motor 6 for attracting and conveying the paper 8 with an attraction force.

The counter electrode 30 is formed, for example, by an aluminum plate-like member having a thickness of 10 mm and disposed at a distance (e.g., 1.1 mm) from the outer peripheral surface of the toner holder 10. To the counter electrode 30, a voltage for attracting developer is applied from the counter electrode voltage power supply 52 so that the electrode 30 can attract the toner 12.

The voltage applied to the counter electrode 30 is a voltage which does not attract the toner 12 electrically held on the toner holder 10 regardless of the toner jumping control. The voltage acts to stably lead the toner 12 passed through gates 24 of the control electrode 20 to positions on the paper 8 where dots are formed.

Consequently, the toner 12 held on the toner holder 10 passes through the gates 24 of the control electrode 20 to be attracted onto the paper 8. The counter electrode 30 is rotated by a driving unit (not illustrated). By rotating the counter electrode 30 is rotated by 180°, the cleaning member 32 attached to the counter electrode 30 comes into contact with the control electrode 20, and then by applying a voltage to the cleaning member 32 in a direction for attracting the toner 12, the cleaning member 32 removes the toner 21 stuck on the control electrode 20.

The distance between the toner holder 10 and the counter electrode 30, the voltage applied from the counter electrode voltage power supply 52 to the counter electrode 30, as well as the material and thickness of the counter electrode are not specified specially. In addition, the counter electrode 30 is formed by a polygonal member and configured in a manner that one side thereof functions as an usual counter electrode when an image is formed and the other sides are respectively stuck by a conductive fiber polymer is bonded.

The cleaning member 32 is structured in a manner that the counter electrode 30 is a base member to which a conductive fiber polymer is bonded by use of adhesive. More concretely, the cleaning member 32 is formed in a manner that, for example, the conductive fiber polymer is formed to be a plate having a width of 5 mm to bond onto the counter electrode 30. The conductive fiber polymer is structured with, e.g., a fiber in which carbon formed into a extra-fine bar is sandwiched into nylon to be electrically conductive, having a fiber length of 4 mm. The resistance value is about 100 kΩ at a humidity of 50%. The single fiber diameter of the cleaning member 32 is 20 μm. The planting density thereof is 8000 fibers/inch$^2$. The material and characteristic values of the conductive fiber polymer are not specified specially. The R-V converter circuit 60 is connected to the cleaning member 32, and converts the resistance value of the cleaning member 32 into a voltage value and transfers the voltage value to the main control unit 70.

The main control unit 70, as shown in FIG. 3, comprises a CPU 71 and storing means 72. The CPU 71 judges the ambient conditions of the image forming unit 3 based on a voltage value transmitted from the R-V converting circuit 60 and data stored in the storing means 72 and determines the value to be set for the power supplies 50 to 52 according to the ambient conditions, whereby the set values are transmitted to the power supply control circuit 80. The power supply control circuit 80 controls the output voltage of each of the power supplies 50 to 52. The power supplies 50 to 52 are, for example, the control electrode voltage power supply 50, the developing bias power supply 51, and the counter electrode voltage power supply 52. The fan motor 6 attracts the paper 8 onto a supporting member 31 with an attracting force to convey. The supporting member 31 is interposed by the counter electrode 30 and the control electrode 20. Therefore, the supporting member 31 has a lot of vent holes for supplying an air flow from the fan motor 6 onto the paper 6.

Hereunder, the configuration of the control electrode 20 will be described. The control electrode 20 is disposed in parallel to the tangential line of the supporting member 31 for supporting the paper 8 and extended two-dimensionally facing the supporting member 31. The control electrode 20 is parallel to a tangential direction of the supporting member 31 for supporting the paper 8 and two-dimensionally extends facing the supporting member 31. The control electrode 20 is structured to enable a toner flow from the toner holder 10 to the supporting member 31 to pass therethrough.

Figure 4:
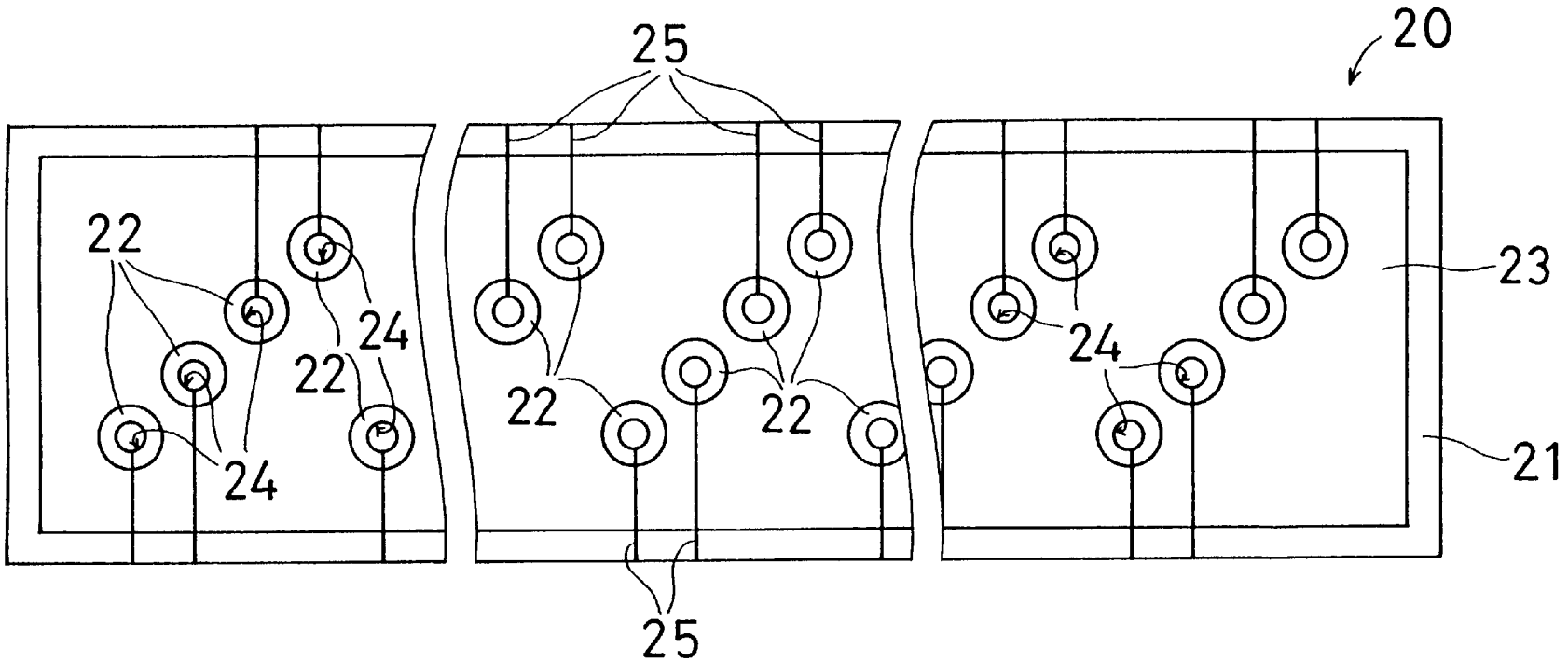
FIG. 4 is a top view of a control electrode 20 in the printer of the first embodiment.

According to a potential applied to the control electrode 20, an electrical field applied to the toner 12 on the surface of the toner holder 10 is changed, so that jumping of the toner from the toner holder 10 onto the paper 8 is controlled. The control electrode 20 is positioned at a distance (e.g. , 100 μm) from the outer peripheral surface of the toner holder 10 and fixed by supporting members (not illustrated). As shown in FIG. 4, the control electrode 20 is composed of: an insulating substrate 21; a high voltage driver (not illustrated); ring-like conductors which are independent of each other, i.e., ring-like electrodes 22; and a plate-like shielded electrode 23. The insulating substrate 21 is made of a material such as polyimide resin with a thickness of 25 μm.

The insulating substrate 21 are provided with a plurality of holes to be the gates 24 in a specified alignment, which will be explained later. Each of the ring-like electrodes 22 is made of a material such as a copper foil, which are disposed around the holes and positioned according to the specified alignment. As a diameter of an opening of each hole is selected, for example, 160 μm. The holes are used for allowing the toner 12 to jump from the toner holder 10 to the counter electrode 30. Hereunder, these holes will be referred to as the gates 24. The shielded electrode 23 is made of a material such as a copper foil, which are provided with openings so as to correspond to the gates 24 and the ring-like electrodes disposed around the gates 24.

The distance between the control electrode 20 and the toner holder 10 is not specified specially. Each of the ring-like electrodes 22 is provided with an opening whose diameter is 220 μm. The size of the gates 24, as well as the material, thickness, and so on of the insulating substrate 21, the ring-like electrodes 22, and the shielded electrode 23 are not specified specially. The number of the gates 24, i.e., the holes provided with the ring-like electrodes 22 is, for example, 2560. Each of the ring-like electrodes is electrically connected to the control electrode voltage power supply 50 via power lines 25 and a high voltage driver (not illustrated). The shielded electrode 23 is electrically connected to the control electrode voltage power supply 50 via the power lines 25.

The number of ring-like electrodes 22 is not specified specially. The surfaces of the ring-like electrodes 22, the shielded electrode 23 and the power lines 25 are covered with an insulating layer (not illustrated) having a thickness of 30 μm, whereby an insulation is ensured among the ring-like electrodes 22, among the power lines 25, as well as between the ring-like electrodes 22 and the power lines 25 that are not connected with each other. In addition, the surfaces of the ring-like electrodes 22, the shielded electrode 23 and the power lines 25 are protected from short-circuiting with other members or conductive materials. The material, thickness, and so on of the insulating layer are not specified specially.

As mentioned above, since an image is formed directly on the paper 8 in the image forming apparatus of the invention, such a developing member as a photosensitive member and a dielectric drum used in a conventional image forming apparatus are not required. Therefore, an operation of transferring an image from a developing member to the paper 8 are omitted and hence an image is prevented from being degraded. Accordingly, the reliability of the apparatus is increased as well as the configuration of the apparatus is simplified to decrease the number of parts used for the apparatus, so that it is possible to reduce the size and the manufacturing cost of the apparatus.

Figure 5:
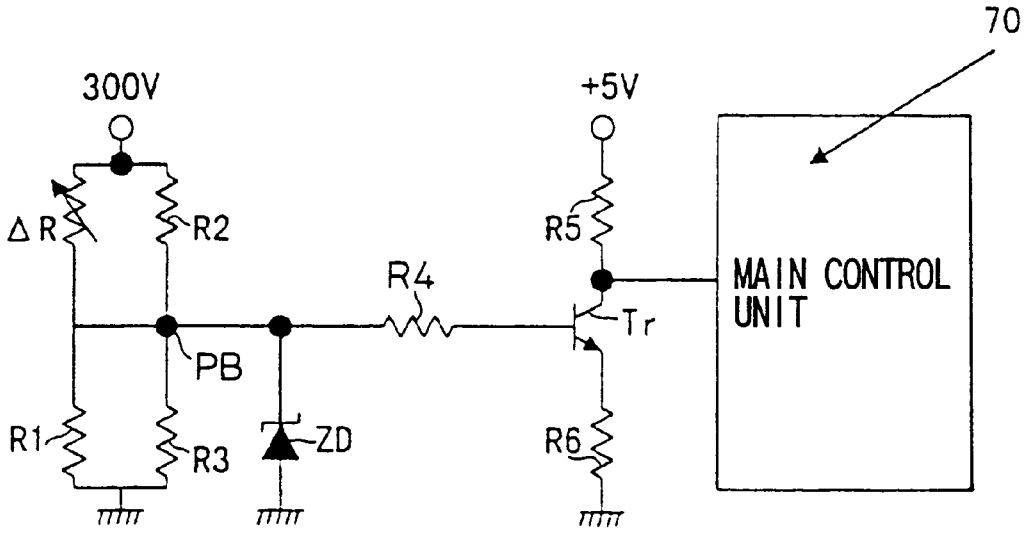
FIG. 5 is an equivalent circuit view of an R-V converter circuit in the printer of the first embodiment.

FIG. 5 is an equivalent circuit diagram showing the electrical configuration of the R-V converter circuit 60. In FIG. 5, the cleaning member 32 is replaced with a variable resistor having a resistance value of ΔR. The R-V converter circuit 60 includes resistors R1 to R6, a Zener diode ZD, and a transistor Tr. One terminal of each of the variable resistor and the resistors R1 to R3 is connected to a forward output terminal of the Zener diode ZD. A base terminal of the transistor Tr is connected to the forward output terminal of the Zener diode ZD via the resistor R4. A collector terminal of the transistor Tr is connected to a power supply for supplying +5V via the resistor R5. The other terminal of each of the variable resistor and the resistor R2 is connected to a power supply for supplying 300V. The other terminal of each of the resistors R2 and R3 as well as the forward input terminal of the Zener diode ZD are grounded. An emitter terminal of the transistor Tr is grounded via the resistor R6. The collector terminal of the transistor Tr is connected to an A-D conversion input port of the main control unit 70.

The conductive fiber polymer of the cleaning member 32 having the variable resistance value ΔR and the other resistors R1 to R3 forms a bridge circuit. A resistance value of the respective resistors R1 to R3 forming the bridge circuit is set so that a current flowing in the bridge circuit is changed according to the ambient conditions. For instance, when the resistance value ΔR of the conductive fiber polymer of the cleaning member 32 falls in a state of high humidity, the resistance values of the resistors R1 to R3 are set so that the current flowing in the bridge circuit is lowered. As the resistance value ΔR of the conductive fiber polymer of the cleaning member 32 is increased in a state of low humidity, the values of the resistors R1 to R3 are properly set so that the current flowing in the bridge circuit is increased. Thus, the resistance values of the resistors R1 to R3 are set so that a voltage of the Zener diode ZD is about 2.5V to 3.0V in a state of humidity of 50%.

Further, the Zener diode ZD is provided for converting the current flowing in the bridge circuit into a voltage and protecting the CPU 71 (in the main control unit 70) from overcurrent. As the Zener diode ZD is used, for example,that of 5.5V and the voltage of the Zener diode ZD is inputted into the A-D converter input port of the CPU 71 via the transistor Tr. Thus, as shown in FIG. 3, the CPU 71 obtains the voltage that is generated in the Zener diode ZD and supplied via the transistor Tr to determine that, for example,: it is a state of high humidity when the obtained voltage is 2V or under; it is a state of normal humidity when the voltage is over 2V and under 4V; and it is a state of low humidity when the voltage is 4V to 5V.

On the basis of the determined humidity state, the CPU 71 obtains a voltage value set for the control electrode to ensure an optimized amount of toner jumping in the respective humidity states of high, normal and low stored in the storing means 72 in the main control unit 70. Then the CPU transfers the voltage value to the power supply control circuit 80 to determine a voltage value of the control electrode voltage power supply 50.

Figure 6:
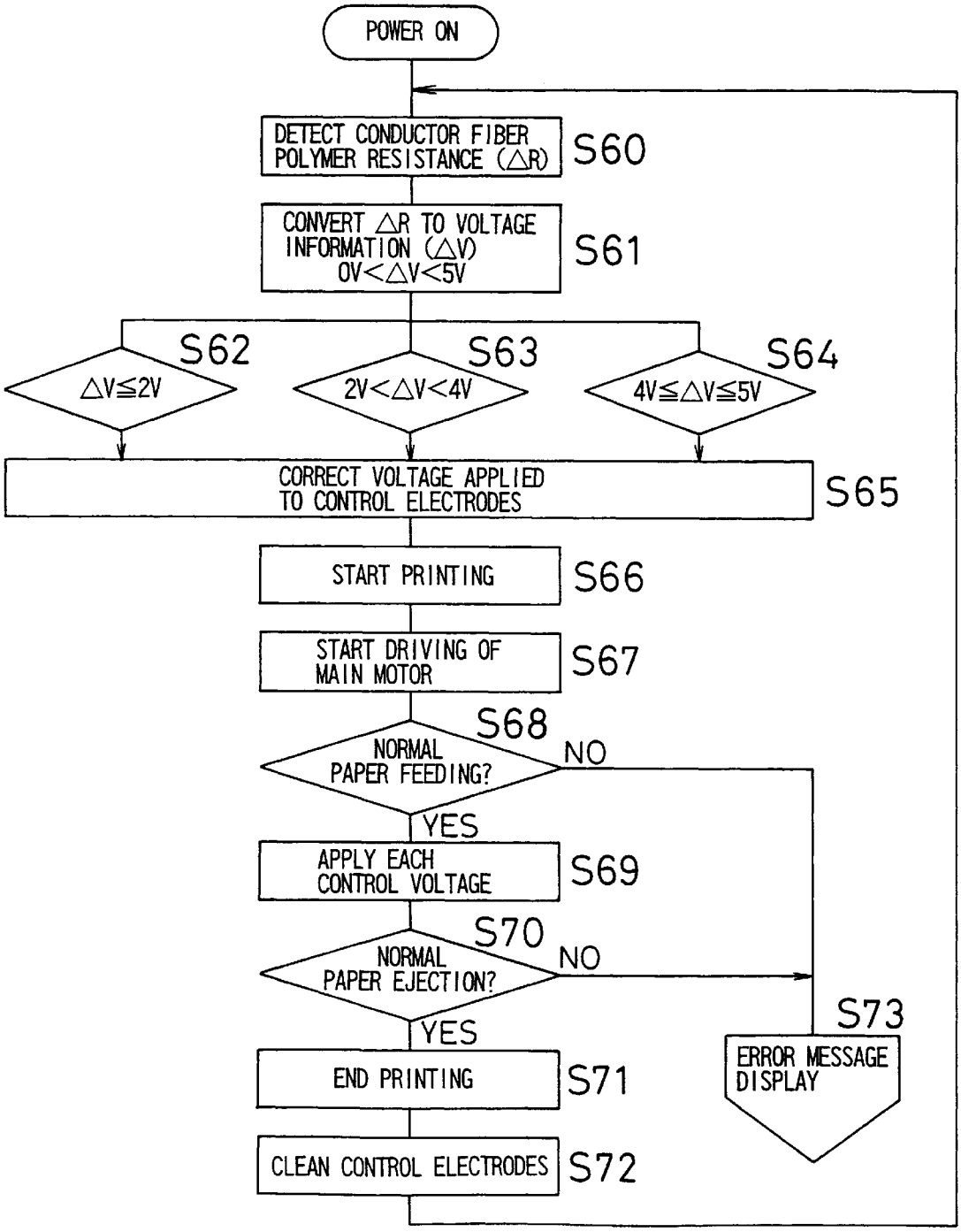
FIG. 6 is a flowchart explaining a printing operation of the printer of the first embodiment.

Hereunder, an image forming operation of the above image forming unit 3 will be described referring to a flowchart of FIG. 6.

The image forming unit 3, which is powered, applies a voltage to the cleaning member 32 and, in step 60, detects the resistance value ΔR of the conductive fiber polymer of the cleaning member 32. The detected resistance value ΔR of the conductive fiber polymer is converted into a voltage level ΔV of 0V to 5V by the R-V converter circuit 60 in step S61. The voltage applied to the cleaning member 32 has a polarity in the direction for attracting the toner 12 stuck on the control electrode 20 toward the cleaning member 32. In addition, a potential difference between the voltage applied to the cleaning member 32 and the voltage applied to the toner holder 10 must be larger than a potential difference between the voltage applied to the control electrode 20 in a direction for preventing the toner from passing through and the voltage applied to the toner holder 10.

On the other hand, the voltage level ΔV converted in the R-V converter circuit 60 is transferred to the CPU 71 in the main control unit 70. In steps S62 to S65, the CPU 71 determines a humidity state among from high, normal and low which the printer and ambient conditions belong to based on the voltage level ΔV and obtains the voltage value to be set for the control electrode according to the determined state. Then the CPU instructs the power supply control unit 80 of the voltage value to be applied to the control electrode 20. The power supply control circuit 80 transmits the designated voltage value to the control electrode voltage power supply 50 as an electrical signal. The control electrode voltage power supply 50 outputs a voltage according to the signal. When the voltage value to be applied to the control electrode is determined, printing is then started in step S66.

When printing is started, image data as information from the host computer is converted into an array pattern of the control electrode to be transferred to a control electrode controller (not illustrated). The main control unit 70 of the printer actuates a driving unit (not illustrated) to drive the pick-up roller 5 in step S67. Consequently, the paper 8 in the paper cassette 7 is fed by the pick-up roller 5 toward the image forming unit 3, and in step S68, the paper feed sensor 203 detects whether or not the paper 8 is normally fed. The main control unit 70 controls the pair of registration rollers 202 so that the paper 8 fed by the pick-up roller 5 is advanced at a speed of 30 mm/sec. Thus, the paper 8 is conveyed to the image forming unit 3.

When it is detected that the paper is normally fed, the counter electrode voltage power supply 52 applies a voltage to the counter electrode 30 in step S69. At the same time, according to image data, the control electrode controller outputs signals, and then a voltage is applied to the control electrode 20 from potential change means which is disposed in the control electrode voltage power supply 50 and for each of the ring-like electrodes 22 and the shielded electrode 23. The voltage applied to the control electrode 20 is controlled by the main control unit 70. For example, in the case where the ambient humidity of the image forming apparatus is 50%, when the toner 12 held on the toner holder 10 is caused to pass through toward the counter electrode 30, a voltage of 150V is applied, and when the toner is kept from passing through, a voltage of −200V is applied. Consequently, the electrical field around the control electrode 20 is controlled. In other words, at the gates 24 of the control electrode, it is properly enabled and disabled according to image data that the toner 12 jumps from the toner holder 10 to the counter electrode 30.

As a result, toner images according to image signals are formed onto the paper 8 moved toward the outlet side of paper at a speed of 30 mm/sec. The paper 8 on which the toner images are formed is conveyed to the fixing unit 103 and the toner images are fixed on the paper 8 in the fixing unit 103. The paper 8 on which the toner images are fixed is ejected by the paper ejection roller onto a paper tray, and in step S70, it is detected by the paper ejection sensor whether or not the paper 8 is ejected normally. On the basis of this detecting operation, when the paper is normally ejected, the main control unit 70 of the printer normally ends the printing operation in step S71. When it is determined that the paper is not normally fed in step S68 or when the paper is not normally ejected in step S70, an error display processing is performed in step S73.

After the printing operation is ended, in step S72, the counter electrode is rotated by a driving unit (not illustrated) to cause the cleaning member 32 to contact the control electrode 20. At this time, a certain voltage (e.g., 300V) for attracting the toner 12 stuck on the control electrode 20 is applied to the cleaning member. Thus, the cleaning member 32 removes the toner 12 stuck on the control electrode 20, and then the operation returns to step S60 from step S72.

Since the toner 12 stuck on the control electrode 20 is removed this way, it can be avoided that the toner 12 stuck on the control electrode 20 in this printing disturbs the toner in the jumping from the toner holder 10 onto the paper 8 and that the toner 12 stuck on the control electrode 20 falls onto the counter electrode 30 due to such a factor as a vibration to stain the back side of the conveyed paper 8 in the next printing or after.

With the image forming operation described above, each element in the image forming unit 3 can be corrected according to the changes of the ambient conditions of the control electrode 20 and the toner 12 stuck on the control electrode 20 can be removed. Thus, the toner 12 passing through the gates 24 is not disturbed in the jumping, so that it is possible to provide a printer including the image forming unit 3, which can stably print out high quality images.

Subsequently, a relationship between the voltage applied to the control electrode and the amount of toner jumping in the respective circumstances will be described referring to FIG. 7.

Figure 7:
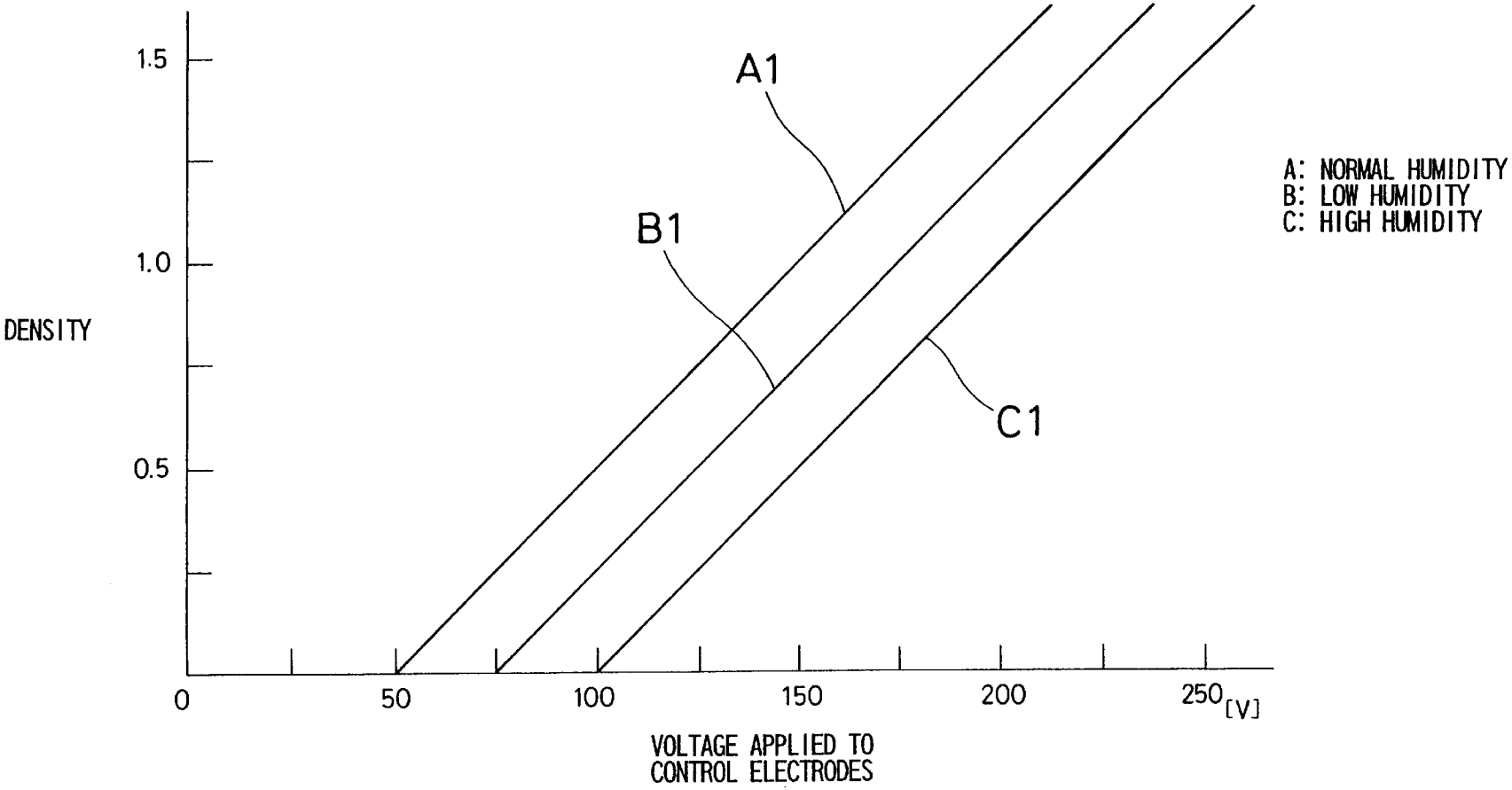
FIG. 7 is a graph showing relationships between a printing density and a voltage applied to the control electrode on each condition in the printer of the first embodiment.

In FIG. 7, lines A1, B1 and C1 indicate the results that the densities of dots formed in the respective states of normal humidity of 50%, low humidity of 20% and high humidity of 80% are measured by use of a Macbeth densitometer. Usually, a satisfactory image can be formed within a density of 0.8 to 1.3 as measured values. The voltage applied to the control electrode that ensures an amount of jumping toner to form a satisfactory image differs among the respective states of normal humidity, low humidity and high humidity. Therefore, in the respective conditions, the voltage applied to the control electrode for ensuring an optimal amount of jumping toner must be set in the control electrode voltage power supply 50.

In order to make a print density 1.0, for example, when the toner 12 held on the toner holder 10 is passed through toward the counter electrode 30, the voltage applied to the control electrode 20 is 150V at a normal humidity of 50%, 175V at a low humidity of 20%, and 200V at a high humidity of 80%, respectively. When the toner 12 held on the toner holder 10 is not passed through toward the counter electrode 30, the voltage applied to the control electrode 20 is −200V in the respective humidity states, so that jumping of the toner 12 can be suppressed enough.

Thus, the storing means 72 stores a value set for the control electrode power supply 50 to output the voltage applied to the control electrode so that the amount of jumping toner for forming a satisfactory image can be obtained in the respective humidity states. As described above, the printer converts the resistance value ΔR of the conductive fiber polymer of the cleaning member 32 into a voltage value ΔV in the R-V converter circuit 60, and the CPU 71 determines the ambient conditions according to the voltage value ΔV and reads data of the voltage value applied to the control electrode, which is stored in the storing means 72 for obtaining a desired amount of jumping toner, according to the ambient conditions to control the control electrode voltage power supply 50. Thus, it is possible to provide a printer including the image forming unit that can accurately and stably form satisfactory images regardless of the ambient conditions and does not need any complicated circuit for computing a value for correcting the voltage of the control electrode.

The image forming unit 3 in this embodiment is used as a printing device in a printer as described above, but the unit may also be used as a printing device in a facsimile machine and a digital copying machine.

Hereunder, a printer in which the image forming apparatus of the second embodiment is used as a printing device will be described. The electrical and mechanical configurations of the printer are the same as those of the printer of the first embodiment, except for the concrete operation of the main control unit. Thus, the same reference numerals used in the first embodiment will be given to portions in the printer of the second embodiment which have the same structures and operations as the printer of the first embodiment, and redundant explanations will be omitted.

Figure 8:
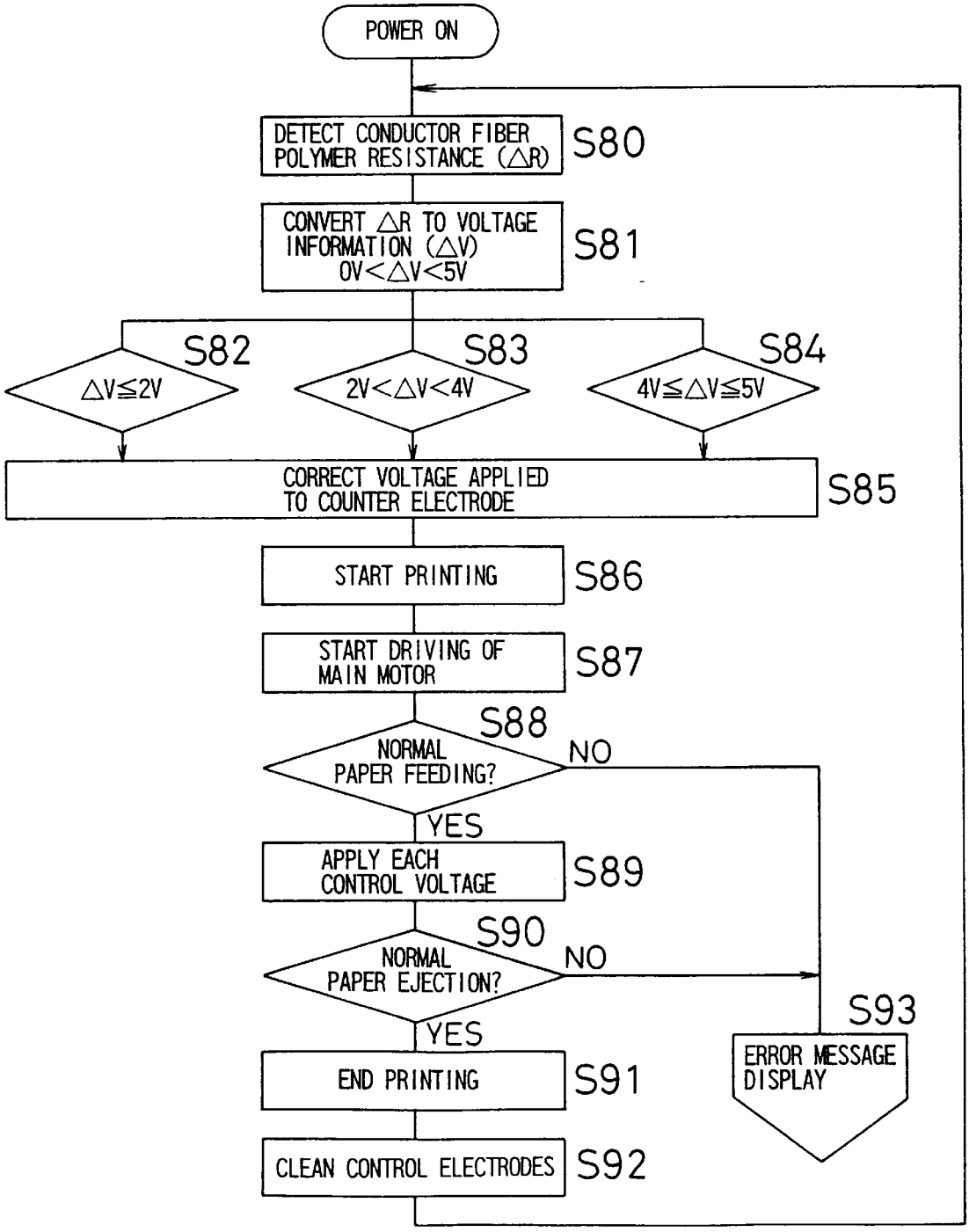
FIG. 8 is a flowchart explaining a printing operation of the printer provided with an image forming apparatus of a second embodiment of the present invention as an image forming unit for printing.

An image forming operation of the above printer will be described referring to the flowchart of FIG. 8.

First, the image forming unit 3, which is powered, applies a voltage to the cleaning member 32 and detects the resistance value ΔR of the conductive fiber polymer of the cleaning member 32 in step S80. The detected resistance value ΔR of the conductive fiber polymer is converted into a voltage level ΔV of 0V to 5V in the R-V converter circuit 60 in step S81. The voltage applied to the cleaning member 32 has a polarity in a direction for attracting the toner 12 stuck on the control electrode 20 toward the cleaning member 32. In addition, the potential difference between the voltage applied to the cleaning member 32 and the voltage applied to the toner holder 10 must be larger than the potential difference between the voltage applied to the control electrode 20 in a direction for keeping the toner from passing through and the voltage applied to the toner holder 10.

On the other hand, the voltage level ΔV converted in the R-V converter circuit 60 is transmitted to the CPU 71 in the main control unit 70. The CPU 71 designates a voltage value to be applied to the counter electrode 30 to the power supply control circuit 80, based on the voltage level ΔV in steps S82 to S85. The power supply control circuit 80 transmits the designate voltage value to the counter electrode voltage power supply 52 as an electrical signal. The counter electrode voltage power supply 52 then outputs a voltage according to the signal. When the voltage value to be applied to the counter electrode is determined, printing operation is started in step S86.

First, image data, which is information of a host computer, is converted according to the array pattern of the control electrode 20, and then transferred to a control electrode control unit (not illustrated). The main control unit 70 actuates a driving unit (not illustrated) to drive the pick-up roller 5 in step S87. Consequently, the paper 8 in the paper cassette 7 is fed by the pick-up roller 5 toward the image forming unit 3 and the paper feed sensor 203 detects whether or not the paper 8 is fed normally in step S88. The main control unit 70 controls the pair of registration rollers so that the paper 8 fed by the pick-up roller 5 is advanced at a speed of 30 mm/sec. Thus, the paper 8 is conveyed to the image forming unit 3. When it is detected that the paper is not normally fed in step S88, an error display processing is performed in step S93.

When it is determined that the paper is fed normally, a voltage controlled by the main control unit 70 based on the ambient conditions of the image forming apparatus is applied to the counter electrode 30 from the counter electrode voltage power supply 52, in step S80. A voltage of 1.5 kV is applied when the humidity around the image forming apparatus is 50%. At the same time, according to image data, the control electrode control unit outputs signals, then a voltage is applied to the control electrode 20 from the potential change means in the control electrode voltage power supply 50 for each of the ring-like electrodes 22 and the shielded electrode 23. For example, to the control electrode 20, 150V is applied for causing the toner 12 held on the toner holder 10 to pass through toward the control electrode 30, and −200V is applied for keeping the toner from passing through. Consequently, the electrical field around the control electrode 20 is controlled.

In other words, at the gates 24 of the control electrode, it is properly enabled and disabled according to image data that the toner 12 jumps from the toner holder 10 to the counter electrode 30. As a result, toner images according to image signals are formed onto the paper 8 moved toward the outlet side of paper at a speed of 30 mm/sec.

The paper 8 on which the toner images are formed is conveyed to the fixing unit 103, and the toner images are then fixed on the paper 8 in the fixing unit 103. The paper 8 on which the toner images are fixed is ejected by the paper ejection roller onto a paper tray, and in step S90, it is detected by the paper ejection sensor whether or not the paper 8 is ejected normally. On the basis of this detecting operation, the main control unit 70 determines whether the printing operation is normally ended. When the paper 8 is normally ejected, it is determined that the printing operation is normally ended. In step S90, when it is detected that the paper 8 is not normally ejected, an error display processing is performed in step S93.

After the printing operation is ended, in step S92, the counter electrode 30 is rotated by a driving unit (not illustrated) to cause the cleaning member 32 to contact the control electrode 20. At this time, for example, a voltage of 300V for attracting the toner 12 stuck on the control electrode 20 is applied to the cleaning member. Thus, the toner 12 stuck on the control electrode 20 is removed. Since the toner 12 stuck on the control electrode 20 is removed this way, it can be avoided that the toner 12 stuck on the control electrode 20 in this printing disturbs the toner 12 in the jumping from the toner holder 10 onto the paper 8 and that the toner 12 stuck on the control electrode 20 falls onto the counter electrode 30 due to such a factor as a vibration to stain the back side of the conveyed paper 8 in the next printing or after.

With the image forming operation described above, an operation of each element in the image forming unit 3 are corrected in response to the changes of the ambient conditions of the image forming unit 3 and the toner 12 stuck on the control electrode 20 are removed. Thus, the toner 12 passing through the gates 24 is not disturbed in the jumping, so that it is possible to provide an image forming apparatus, which can stably print out high quality images.

Hereunder, the R-V converter circuit 60 provided in the image forming apparatus of the second embodiment will be described. The equivalent circuit diagram of the R-V converter circuit 60 is the same as that shown in FIG. 5. In the R-V converter circuit 60, as shown in FIG. 5, a bridge circuit is formed by the conductive fiber polymer of the cleaning member 32 having a variable resistance value ΔR, and other resistors R1 to R3. The resistors R1 to R3 that forms the bridge circuit have resistance values which are set so that, for example, when the resistance value ΔR of the conductive fiber polymer of the cleaning member 32 is lowered, the current flowing in the bridge circuit is decreased.

As the resistance value ΔR of the conductive fiber polymer of the cleaning member 32 is increased in a low humidity state, the values of the resistors R1 to R3 are set properly so that the current flowing in the bridge circuit is increased. Thus, the values of the resistors R1 to R3 are set so that the voltage of the Zener diode ZD becomes, for example, about 2.5V to 3.0V at a humidity of 50%. The Zener diode ZD converts the current flowing in the bridge circuit into a voltage and protects the CPU 71 in the main control unit 70 from overcurrent. As this Zener diode ZD is used, for example, that of 5.5V and the voltage of the Zener diode ZD is inputted to the A-D converter input port of the CPU 71 via the transistor Tr.

Thus, as shown in FIG. 3, the CPU 71 obtains the voltage that is generated in the Zener diode ZD and supplied via the transistor Tr in steps S82 to S84, and determines that, for example,: it is a state of high humidity when the obtained voltage in steps S82 to 84 is 2V or under; it is a state of normal humidity when the voltage is over 2V and under 4V; and it is a state of low humidity when the voltage is 4V to 5V. On the basis of the humidity state determined in step S85, the CPU 71 obtains a set voltage value to be applied to the counter electrode for securing an optimal amount of jumping toner in each humidity state of high, normal and low stored in the storing means 72, transfers the set voltage value to the power supply control circuit 80, to determine the voltage value of the counter electrode voltage power supply 52.

Figure 9:
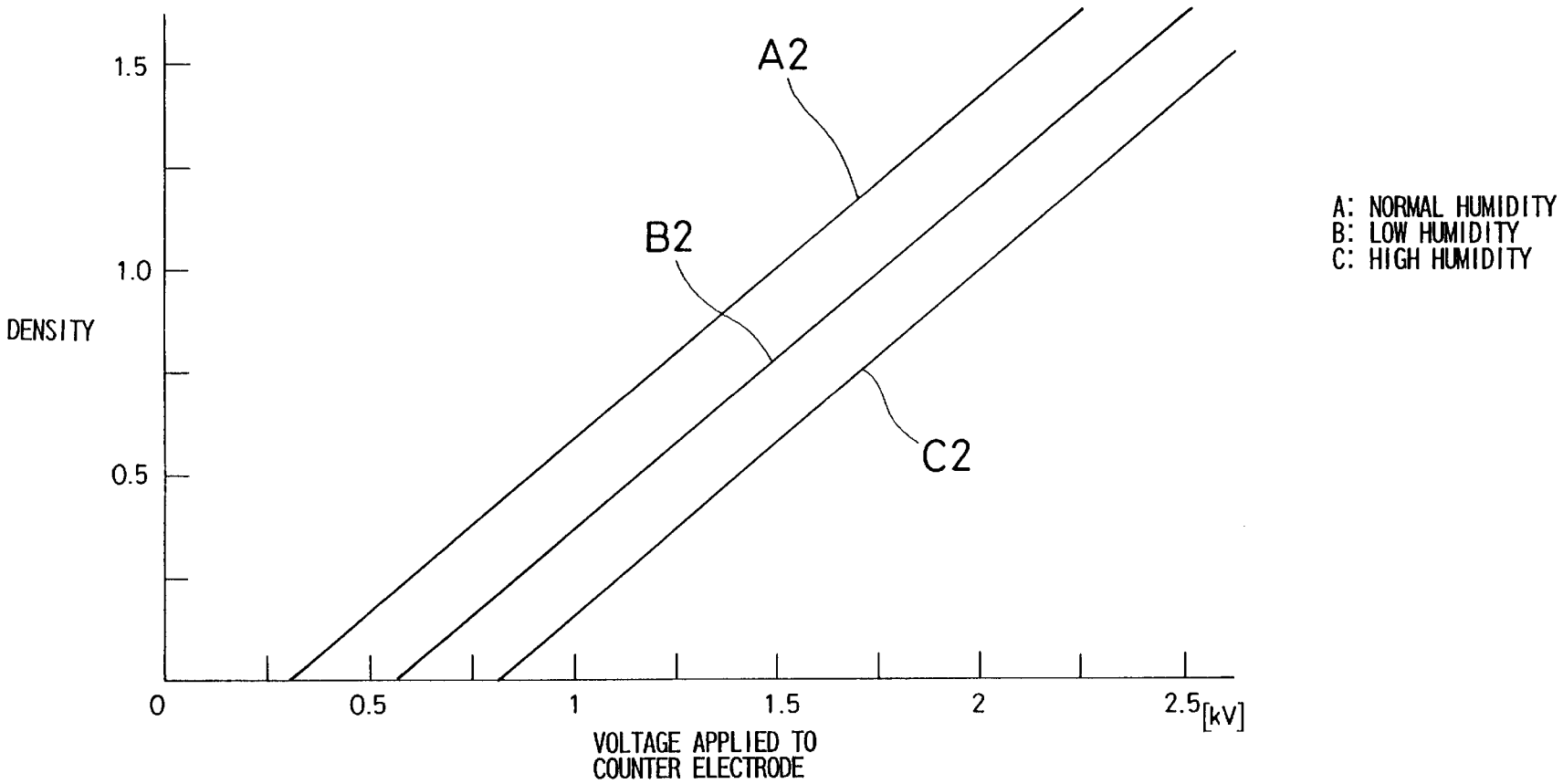
FIG. 9 is a graph showing relationships between a printing density and a voltage applied to a counter electrode on each condition in the printer of the second embodiment.

Subsequently, a relationship between the voltage applied to the control electrode and the amount of jumping toner in the respective circumstances will be described referring to FIG. 9. In FIG. 9, lines A2, B2 and C2 indicate the results that the densities of dots formed in the respective states of normal humidity of 50%, low humidity of 20% and high humidity of 80% are measured by use of a Macbeth densitometer. Usually, a satisfactory image can be formed within a density of 0.8 to 1.3 as measured values. The voltage applied to the control electrode that ensures an amount of jumping toner to form a satisfactory image differs, depending on the respective states of normal humidity, low humidity and high humidity. Therefore, in the respective conditions, the voltage applied to the control electrode for ensuring an optimal amount of jumping toner must be set in the control electrode voltage power supply 52.

In order to make a print density 1.0, for example, when the toner 12 held on the toner holder 10 is passed through toward the counter electrode 30, the voltage applied to the control electrode is 1.5 kV at a normal humidity of 50%, 1.75 kV at a low humidity of 20%, and 2.0 kV at a high humidity of 80%, respectively. Thus, based on FIG. 9, the set values of the counter electrode voltage power supply 52 for outputting a voltage applied to the counter electrode are stored in the storing means 72, a proper amount of Jumping toner to form satisfactory images in each humidity state can be obtained.

As described above, the image forming apparatus of the second embodiment converts the resistance value ΔR of the conductive fiber polymer of the cleaning member 32 into a voltage value ΔV in the R-V converter circuit 60. The CPU 71 determined the ambient conditions according to the voltage value ΔV, reads out the set value of the voltage to be applied to the counter electrode, based on the ambient conditions. The set value is stored in the storing means 72 and used for obtaining a desired amount of jumping toner. The CPU 71 then controls the counter electrode voltage power supply 52. The present invention can thus provide an image forming apparatus that can accurately and stably form satisfactory images regardless of changes of the ambient conditions and does not need any complicated circuit for computing a value to correct the voltage of the counter electrode 30. The image forming apparatus of the second embodiment is used as a printing device in a printer as described above, but the apparatus may also be used as a printing device in a facsimile machine and a digital copying machine.

Hereunder, a printer in which an image forming apparatus of the third embodiment is used as a printing device will be described. The electrical and mechanical configurations of the printer are the same as those of the printer of the first embodiment, except for the concrete operation of the main control unit. Thus, the same reference numerals used in the first embodiment will be given to portions in the printer of the third embodiment which have the same structures and operations as the printer of the first embodiment, and redundant explanations will be omitted.

Figure 10:
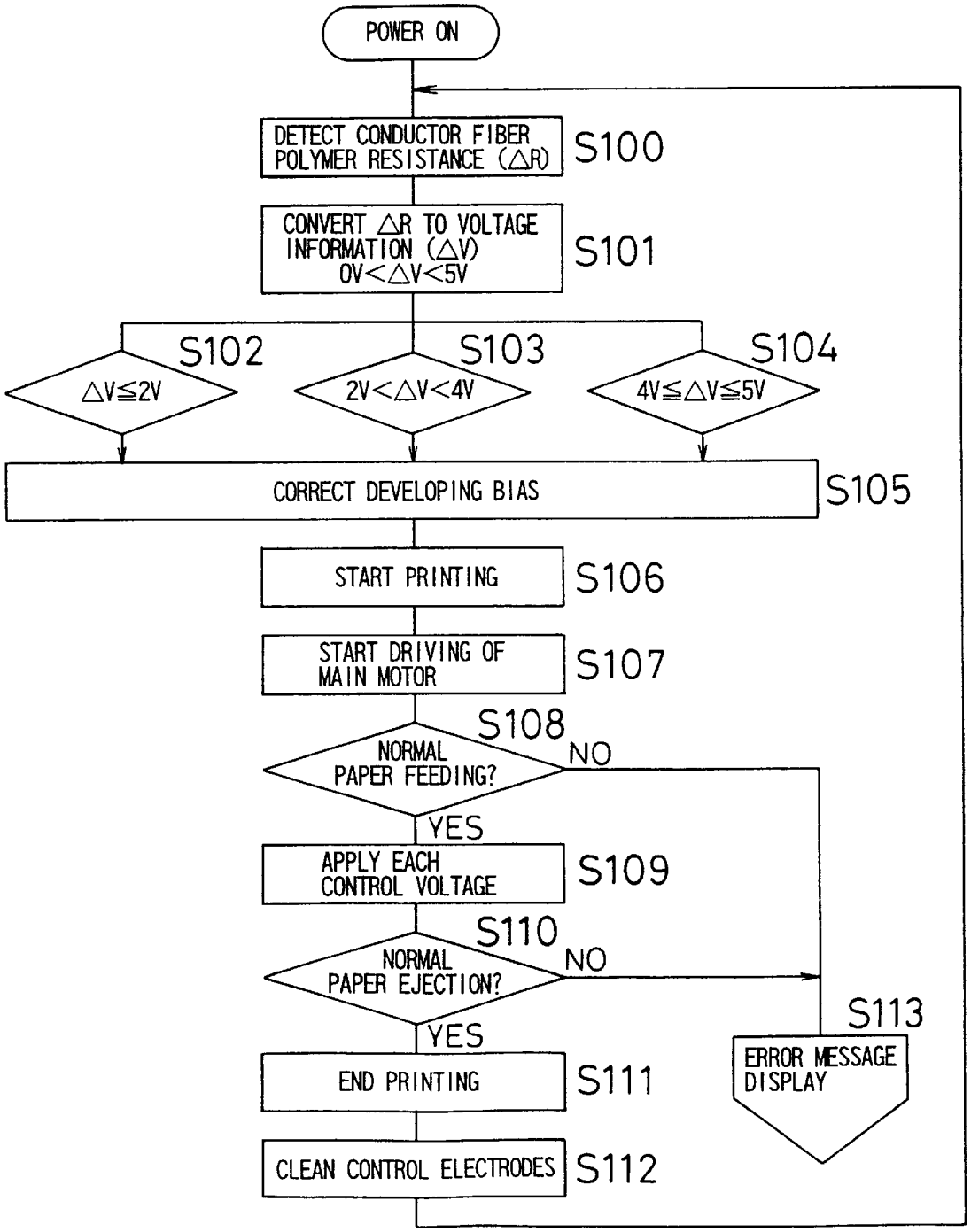
FIG. 10 is a flowchart explaining a printing operation of the printer provided with an image forming apparatus of a third embodiment of the present invention as an image forming unit for printing.

An image forming operation of the above printer will be described referring to the flowchart of FIG. 10.

First, the image forming apparatus, which is powered, applies a voltage to the cleaning member 32, and in step S100, detects the resistance value ΔR of the conductive fiber polymer of the cleaning member 32. The detected resistance value ΔR of the conductive fiber polymer is converted into a voltage level ΔV of 0V to 5V in the R-V converter circuit 60 in step S101. The voltage applied to the cleaning member 32 has a polarity in a direction for attracting the toner 12 stuck on the control electrode 20 toward the cleaning member 32. In addition, the potential difference between the voltage applied to the cleaning member 32 and the voltage applied to the toner holder 10 must be larger than the potential difference between the voltage applied to the control electrode 20 in a direction for keeping the toner from passing through and the voltage applied to the toner holder 10. On the other hand, the voltage level ΔV converted in the R-V converter circuit 60 is transmitted to the CPU 71 in the main control unit 70. The CPU 71 indicates a voltage value to be applied to the toner holder 10, to the power supply control circuit 80 based on the voltage level ΔV in steps S102 to S105. The power supply control circuit 80 transmits the indicated voltage value to the developing bias power supply 51 as an electrical signal. The developing bias power supply 51 then outputs a voltage according to the signal as a developing bias voltage. When the developing bias voltage is determined, printing operation is started in step S106.

First, image data, which is information of a host computer, is converted according to the array pattern of the control electrode 20, and then transferred to a control electrode control unit (not illustrated). The main control unit 70 actuates a driving unit (not illustrated) to drive the pick-up roller 5 in step S107. Consequently, the paper 8 in the paper cassette 7 is fed by the pick-up roller 5 toward the image forming unit 3 and the paper feed sensor 203 detects whether or not the paper 8 is fed normally in step S108. The main control unit 70 controls the pair of registration rollers so that the paper 8 fed by the pick-up roller 5 is advanced at a speed of 30 mm/sec. Thus, the paper 8 is conveyed to the image forming unit 3. When it is detected that the paper is not normally fed in step S108, an error display processing is performed in step S113.

When it is determined that the paper is fed normally, a voltage controlled by the main control unit 70 is applied to the toner holder from the developing bias power supply 51, in step S109. For example, a voltage of 150V is applied when the humidity around the image forming apparatus is 50%. At the same time, the toner holder 10 is rotated by a driving unit (not illustrated), with the result that the toner 12 is conveyed. Furthermore, a voltage is applied to the counter electrode 30 from the counter electrode voltage power supply 52. At the same time, according to image data, the control electrode control unit outputs signals, then a voltage is applied to the control electrode 20 from the potential change means in each of the ring-like electrodes 22 and the shielded electrode 23.

For example, to the control electrode 20, 150V is applied for causing the toner 12 held on the toner holder 10 to pass through toward the control electrode 30, and −200V is applied for keeping the toner from passing through. Consequently, the electrical field around the control electrode 20 is controlled. In other words, at the gates 24 of the control electrode 20, it is properly enabled and disabled according to image data that the toner 12 jumps from the toner holder 10 to the counter electrode 30. As a result, toner images according to image data are formed onto the paper 8 moved toward the outlet side of paper at a speed of 30 mm/sec. The paper 8 on which the toner images are formed is fed into the fixing unit 103 and the toner images are fixed on the paper 8 in the fixing unit 103.

The paper 8 on which the toner images are fixed is then ejected by the paper ejection roller onto a paper tray, and in step S110, it is detected by the paper ejection sensor whether or not the paper 8 is ejected normally. On the basis of this detection operation, when the paper 8 is normally ejected, the main control unit 70 determines that the printing operation is ended normally, in step S111. When the paper 8 is not normally ejected, an error display processing is performed in step S113.

After the printing operation is ended, in step S112, the counter electrode 30 is rotated by a driving unit (not illustrated) to make the cleaning member 32 contact the control electrode 20. At this time, for example, a voltage of 300V for attracting the toner 12 stuck on the control electrode 20 is applied to the cleaning member 32. Accordingly, the toner 12 stuck on the control electrode 20 is removed therefrom.

Since the toner 12 stuck on the control electrode 20 is removed this way, it can be avoided that the toner 12 stuck on the control electrode 20 in this printing disturbs the toner 12 in the jumping from the toner holder 10 onto the paper 8 and that the toner 12 stuck on the control electrode 20 falls onto the counter electrode 30 due to such a factor as a vibration to stain the back side of the conveyed paper 8 in the next printing or after.

In this embodiment, a configuration that the voltage applied to the toner holder 10 is corrected is illustrated, but any voltage applied to any part of the toner supplier 4 may be applied in order to supply the toner 12, without restricted to the embodiment.

With the image forming operation described above, an operation of each element in the image forming unit 3 are corrected in response to the changes of the ambient conditions of the image forming unit 3 and the toner 12 stuck on the control electrode 20 is removed. Thus, the toner 12 passing through the gates 24 is not disturbed in the jumping, so that it is possible to provide an image forming apparatus, which can stably print out high quality images.

Hereunder, the R-V converter circuit 60 provided in the printer of the third embodiment will be described. The equivalent circuit of the R-V converter circuit 60 of the printer of the third embodiment is the same as that shown in FIG. 5. In the R-V converter circuit 60, as shown in FIG. 5, a bridge circuit is formed by the conductive fiber polymer of the cleaning member 32 having a variable resistance value ΔR, and other resistors R1 to R3. The resistors R1 to R3 that forms the bridge circuit have resistance values which are set so that, for example, when the resistance value ΔR of the conductive fiber polymer of the cleaning member 32 is lowered in the high humidity state, the current flowing in the bridge circuit is decreased. Further, as the resistance value ΔR of the conductive fiber polymer of the cleaning member 32 is increased in a low humidity state, the values of the resistors R1 to R3 are set properly so that the current flowing in the bridge circuit is increased.

For instance, the resistance values of the resistors R1 to R3 are set so that the voltage of the Zener diode ZD is about 2.5V to 3.0V at a humidity of 50%. The Zener diode ZD converts the current flowing in the bridge circuit into a voltage and protects the CPU 71 in the main control unit 70 from overcurrent. As this Zener diode ZD is used, for example, that of 5.5V and the voltage of this Zener diode ZD is inputted to the A-D converter input port of the CPU 71 via the transistor Tr.

As shown in FIG. 3, the CPU 71 obtains the voltage that is generated in the Zener diode ZD and supplied via the transistor Tr, and determines that, for example,: it is a state of high humidity when the obtained voltage in steps S102 to 104 is 2V or under; it is a state of normal humidity when the voltage is over 2V and under 4V; and it is a state of low humidity when the voltage is 4V to 5V. On the basis of the humidity state determined in step S105, the CPU 71 in the main control unit 70 obtains a set value of the developing bias for securing an optimal amount of jumping toner in each humidity state of high, normal and low stored in the storing means 72, and transfers the set value to the power supply control circuit 80, to determine the voltage value of the developing bias power supply 51.

Subsequently, a relationship between the developing bias and an amount of jumping toner in each condition will be described, referring to FIG. 11.

Figure 11:
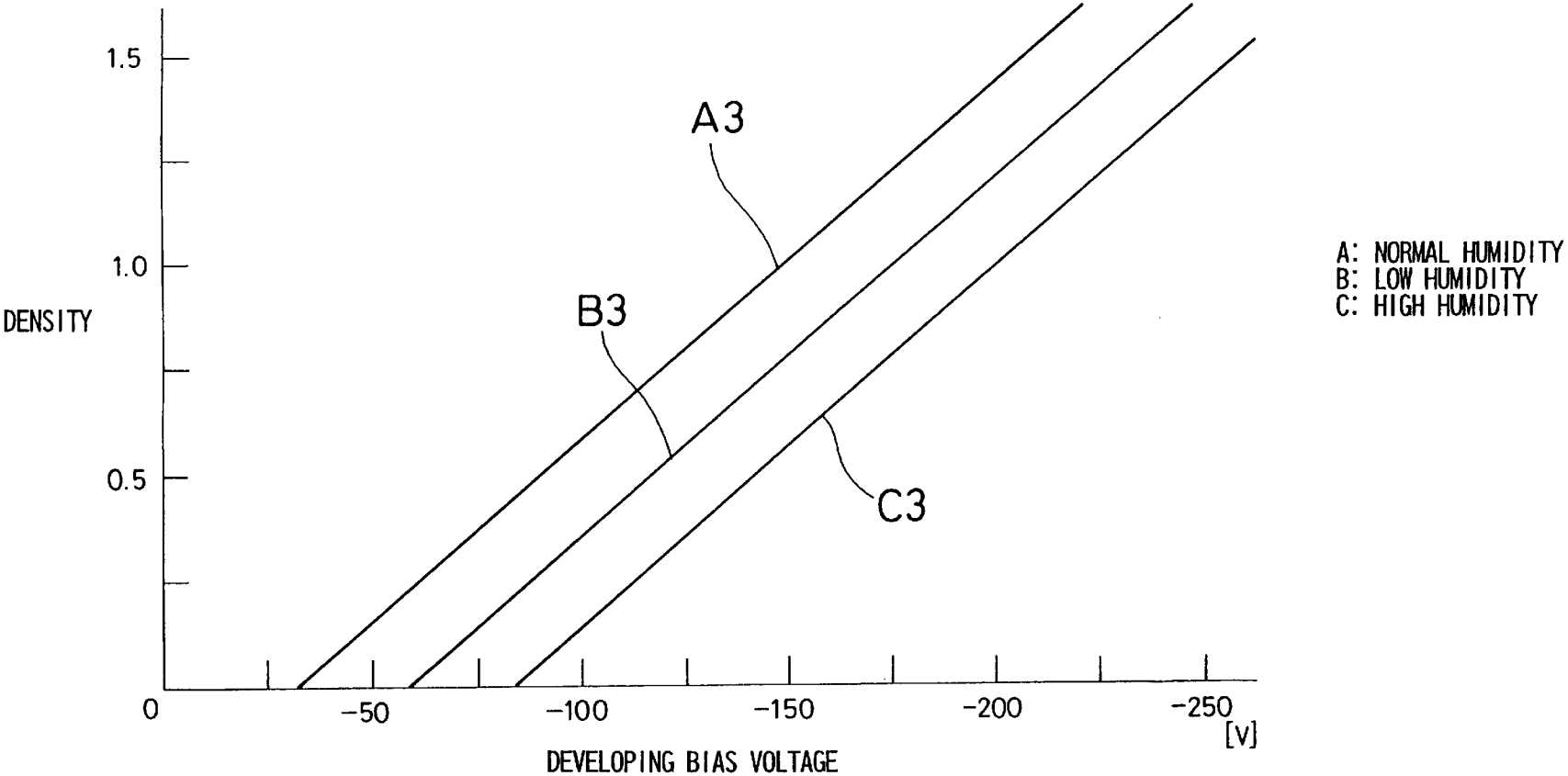
FIG. 11 is a graph showing relationships between a printing density and a developing bias in each condition in the printer of the third embodiment.

In FIG. 11, lines A3, B3 and C3 indicate the results that the densities of dots formed in the respective states of normal humidity of 50%, low humidity of 20% and high humidity of 80% are measured by use of a Macbeth densitometer. Usually, a satisfactory image can be formed within a density of 0.8 to 1.3 as measured values. The developing bias that ensures an amount of jumping toner to form a satisfactory image differs depending on the respective states of normal humidity, low humidity and high humidity. Therefore, in the respective conditions, the developing bias for ensuring an optimal amount of jumping toner must be set in the developing bias power supply 51.

In order to make a print density 1.0, for example, when the toner 12 held on the toner holder 10 is passed through toward the counter electrode 30, the developing bias voltage is −150V at a normal humidity of 50%, −175V at a low humidity of 20%, and −200V at a high humidity of 80%, respectively.

Thus, based on FIG. 11, the set values of the developing bias power supply 51 so that a proper developing bias can be output to obtain a proper amount of toner for jumping on each humidity level to form satisfactory images. As described above, the image forming unit 3 converts the resistance value ΔR of the conductive fiber polymer of the cleaning member 32 into a voltage ΔV in the R-V converter circuit 60, and the CPU 71 determines the ambient conditions according to the voltage value ΔV and reads, according to the ambient conditions, the developing bias data for obtaining a desired amount of jumping toner, stored in the storing means 72 to control the developing bias power supply 51. Thus, images which are accurately and stably satisfactory can be formed regardless of the ambient conditions, to provide an image forming apparatus in which any complicated circuit is not needed for computing a value to correct the developing bias voltage.

The image forming unit in the third embodiment is used as a printing device in a printer as described above, but the unit may also be used as a printing device in a facsimile machine and a digital copying machine.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a holder for holding at least one color developer;

a counter electrode disposed facing the holder;

high voltage supplying means for supplying a high voltage to generate a potential difference between the holder and the counter electrode; and a control electrode having an insulating substrate disposed between the holder and the counter electrode, a plurality of gates which are provided on the insulating substrate and serve as passages of the developer, and at least one electrode provided around each of the plurality of gates, the apparatus controlling by the potential difference generated between the holder and the counter electrode whether or not to pass the developer through the gates to form images onto a recording medium conveyed between the control electrode and the counter electrode, the apparatus further comprising:

cleaning means for removing the developer deposited on the control electrode, the cleaning means being formed by a member having a characteristic value variable according to ambient conditions;

detecting means for detecting the characteristic value;

determining means for determining the ambient conditions of an area near the cleaning means based on a detection result of the detecting means; and state controlling means for controlling a state of at least one among the holder, the counter electrode, the high voltage supplying means and the controlling electrode, based on a determination result by the determining means, so that each of the holder, the counter electrode, the high voltage supplying means and the controlling electrode is brought in a state that desired images can be formed.

2. The image forming apparatus of claim 1, wherein the detecting means detects the characteristic value at least before an image forming operation is started.

3. The image forming apparatus of claim 1, wherein the state controlling means controls a potential of the control electrode.

4. The image forming apparatus of claim 1, wherein the state controlling means controls the potential difference between the counter electrode and the holder.

5. The image forming apparatus of claim 1, wherein the state controlling means controls a potential applied to the holder.

6. The image forming apparatus of claim 1, wherein the cleaning means is formed by a conductive fiber polymer.

7. The image forming apparatus of claim 1, the image forming apparatus further comprising storage means for storing a plurality of control data sets, which are used for changing the state of the at least one among the holder, the counter electrode, the high voltage supplying means and the controlling electrode, into a state that the developer can be conveyed by a predetermined amount under a plurality of predetermined ambient conditions, wherein the state controlling means reads out any one of the control data sets from the storing means corresponding to the ambient conditions determined by the determining means and controls the at least one among the holder, the counter electrode, the high voltage supplying means and the controlling electrode, on the basis of the control data set read out.

8. The image forming apparatus of claim 1, wherein the detecting means includes a bridge circuit composed of the member and three resistors.

9. The image forming apparatus of claim 1, wherein the ambient conditions includes at least humidity of an area around the cleaning means.

* * * * *